US007532735B2

(12) United States Patent
Whitehouse et al.

(10) Patent No.: US 7,532,735 B2
(45) Date of Patent: May 12, 2009

(54) ADJUSTABLE MOUNTING SYSTEM FOR SPEAKER ENCLOSURES

(75) Inventors: Ryan P. Whitehouse, Eagan, MN (US); Michael Carpenter, Brooklyn Park, MN (US); Christopher Hart, Richfield, MN (US)

(73) Assignee: Bosch Security Systems, Inc., Fairport, NY (US)

( * ) Notice: Subject to any disclaimer, the term of this patent is extended or adjusted under 35 U.S.C. 154(b) by 506 days.

(21) Appl. No.: 11/126,067

(22) Filed: May 9, 2005

(65) Prior Publication Data

US 2006/0249647 A1 Nov. 9, 2006

(51) Int. Cl.
*H04R 1/02* (2006.01)

(52) U.S. Cl. ..... 381/387; 381/386; 381/390; 381/395

(58) Field of Classification Search ..... 381/390, 381/386–387, 395; 402/53, 82–83; 181/199; 403/53, 82–83
See application file for complete search history.

(56) References Cited

U.S. PATENT DOCUMENTS 4,042,778 A * 8/1977 Clinton ..... 381/182
5,201,896 A * 4/1993 Kruszewski ..... 248/278.1
5,704,578 A 1/1998 Fischer et al.
6,467,745 B1 10/2002 Sickels
2003/0129018 A1* 7/2003 McDevitt ..... 403/120
2003/0174855 A1* 9/2003 Hawkins et al. ..... 381/386
2005/0100187 A1* 5/2005 Yang ..... 381/386

FOREIGN PATENT DOCUMENTS

EP 0025118 A 3/1981

* cited by examiner

*Primary Examiner*—Curtis Kuntz
*Assistant Examiner*—Jesse A Elbin
(74) *Attorney, Agent, or Firm*—Fredrikson & Byron, P.A.

(57) ABSTRACT

A speaker mounting assembly adjustably supports a speaker from a mounting surface. The speaker mounting assembly comprises a speaker enclosure, a support arm, and a mounting bracket mounted to a mounting surface. The speaker enclosure defines a window opening, and the window opening is constructed to receive entry of an insert portion of the support arm. A latch supported by the enclosure and extending from the window opening can be used to engage with the insert portion to automatically retain the support arm when the insert portion is inserted into the window opening. A post extends within the enclosure window and the insert portion engages the post so as to enable pivoting of the speaker enclosure about the support arm. A set screw extends through a channel of the support arm toward the mounting bracket and based on position of the screw, permits pivoting of the support arm about the mounting bracket.

18 Claims, 10 Drawing Sheets

ADJUSTABLE MOUNTING SYSTEM FOR SPEAKER ENCLOSURES

FIELD OF THE INVENTION

The invention relates to mounting systems, and in particular, embodiments of the invention relate to mounting systems for objects having enclosures.

BACKGROUND OF THE INVENTION

A wide variety of commercial products include enclosures. Generally, the enclosures are designed to protect mechanical and/or electrical components which collectively operate to provide the functioning of the products. As such, the components are contained within such enclosures. For example, a speaker often has a enclosure to contain the mechanical and electrical components generally used to receive electrical signals and in turn, radiate sound waves (corresponding to the electrical signals) over an audible bandwidth.

In many cases, these enclosures are designed to be mounted to surfaces. For example, using the speaker example from above, it is often desirable to mount the speakers at a certain height to enable persons to have a better vantage of hearing the sound waves emanating from the speakers. In some cases, the enclosures can be directly mounted to such surfaces (e.g., via some type of mounting bracket); however, it is often the case where the enclosures are operatively mounted to the surfaces via mounting systems (e.g., including more than one mounting element) to enable aiming the enclosure in a certain direction. One example of such a mounting system can include a mounting bracket as well as a support arm that enables the enclosure to be aimed.

One shortcoming of using such mounting systems often lies in making the initial adjustment of the enclosures during their installation. For example, during an installation which requires the enclosure to be mounted at an elevated height, a person may have to support the enclosure at the same time the person is adjusting the enclosure with respect to the mounting system. As such, it can be difficult to additionally use tools to lock the enclosure in the desired position while also supporting such enclosure. One solution to this is to make such enclosure position adjustments while on the ground in order to be able to lock the enclosure in position without having to support the weight of the enclosure. However, a similar problem is encountered when the installer attempts to mount the enclosure and mounting system on the surface as tools used for such mounting must be used while supporting the enclosure and mounting system.

The embodiments of the invention are directed to overcoming, or at least reducing the effects of, these and/or other shortcomings.

BRIEF SUMMARY OF THE INVENTION

Embodiments of the present invention provide mounting apparatus used for adjustably supporting a speaker from a mounting surface. Generally, a speaker mounting assembly is provided for adjustably supporting a speaker from a mounting surface. As such, in one embodiment, the speaker mounting assembly comprises a support arm having an insert portion, a speaker enclosure, a latch, and a mounting bracket. The speaker enclosure holds at least one transducer and defines a window opening, and the window opening is constructed to receive entry of the support arm insert portion. The latch is supported by the speaker enclosure extending from the window opening. The latch engages with the insert portion to automatically retain the support arm when the insert portion is inserted into the window opening. The latch is releasable from the insert portion to permit removal of the support arm. The mounting bracket is attachable to a mounting surface for mounting the assembly to the mounting surface, and the support arm extends from the mounting bracket. In another embodiment, the speaker mounting assembly comprises a support arm having an insert portion, a speaker enclosure, and a post. The support arm is operatively attachable to a mounting surface for mounting the speaker to the mounting surface. The speaker enclosure holds at least one transducer and defines a window opening, and the window opening is constructed to receive entry of the support arm insert portion. The post extends within the enclosure window and the insert portion engages the post so as to enable pivoting of the speaker enclosure about the support arm.

In a further embodiment, a lockable swivel speaker mounting assembly is provided for adjustably supporting a speaker from a mounting surface. The lockable speaker mounting assembly comprises a support arm, a speaker enclosure, a mounting bracket, a set screw, and a bearing. The support arm has an elongate central portion and a channel extending through the central portion. The speaker enclosure holds at least one transducer and is releasably latchable to the support arm. The mounting bracket is attachable to a mounting surface for mounting the assembly to the mounting surface, and the support arm extends from and pivots about the mounting bracket. The set screw extends through the channel towards the mounting bracket. The set screw is adjustable from a first position that locks pivoting of the support arm about the mount bracket to a second position that permits pivoting of the support arm about the mounting bracket. The bearing is positioned between the set screw and the mounting bracket, and the set screw bears against the bearing and the mounting bracket when adjusted to the first position.

DETAILED DESCRIPTION OF THE INVENTION

Figure 1:
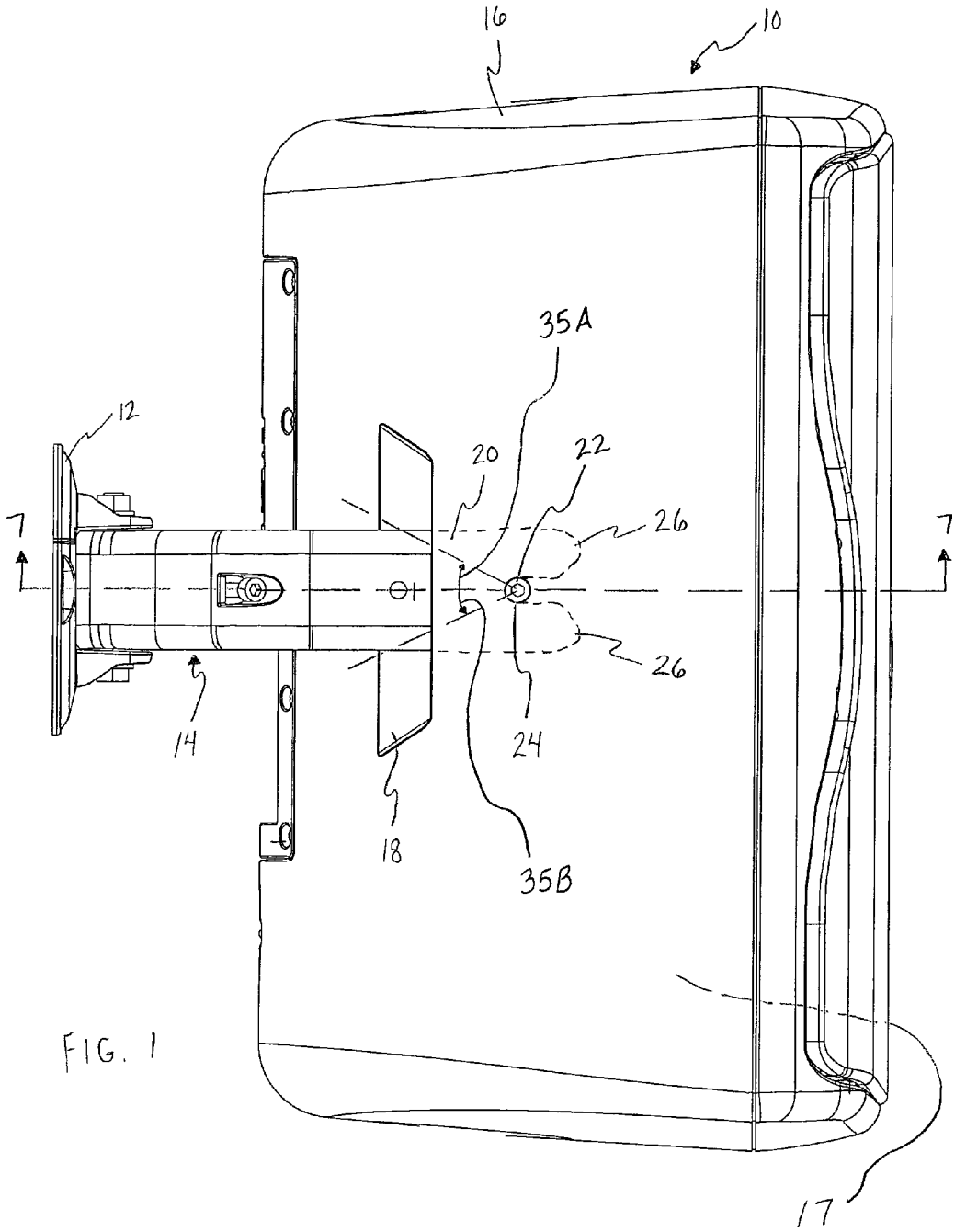
FIG. 1 shows a top view of a enclosure and mounting system in accordance with certain embodiments of the invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings.

Skilled artisans will recognize the embodiments provided herein have many useful alternatives that fall within the scope of the present teachings. For example, certain embodiments of the invention are described in which a speaker enclosure is operatively supported by a mounting bracket; however, it should be appreciated that embodiments can also involve objects having enclosures other than speakers (e.g., light fixtures, sensors, satellite dishes, etc.). Additionally, certain embodiments of the invention are discussed in which a supporting bracket is mounted to a wall surface; however, it should be appreciated that embodiments can also involve mounting the bracket to surfaces other than walls (e.g., ceilings, roofs, floors, etc.). Further, certain embodiments of the invention are mentioned in which the supporting bracket is mounted to a building surface; however, it should be appreciated that embodiments can also involve mounting the bracket to surfaces other than those associated with a building (e.g., vehicle surfaces, equipment surfaces, ground surfaces, etc.).

Figure 2:
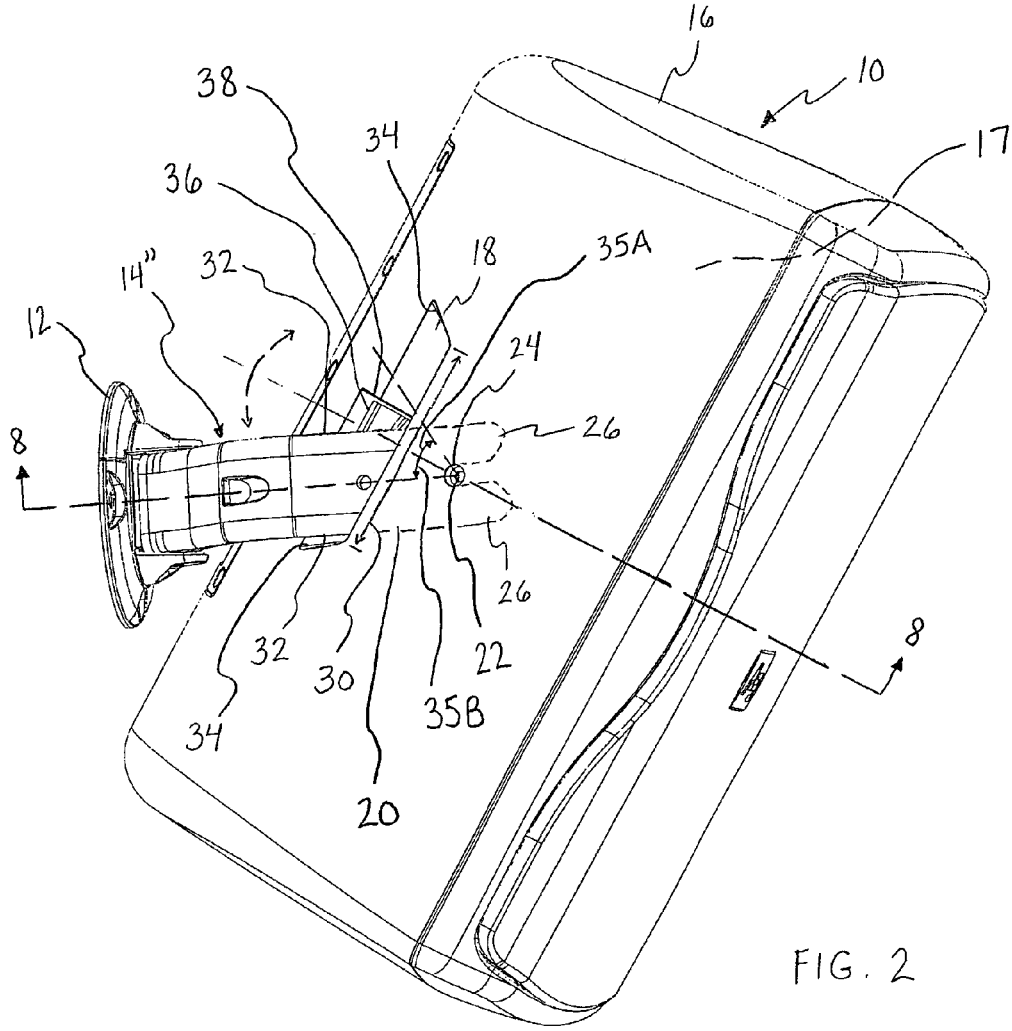
FIG. 2 shows a top view of an alternate enclosure and mounting system in accordance with certain embodiments of the invention.

In certain embodiments of the invention, as shown in FIG. 1, a speaker 10 is operatively mounted to a mounting bracket 12 via a support arm 14'. The speaker 10 includes a enclosure 16 that generally contains at least one transducer shown generally at 17 and defines a window opening 18 constructed to receive an insert portion 20 of the support arm 14'. The support arm 14' extends from the bracket 12 to the enclosure 16, with the support arm insert portion 20 being received by the opening 18. In certain embodiments of the invention, as shown in FIGS. 1 and 2, the support arm insert portion 20 engages a segment of a post 22 that extends through the opening 18. In certain embodiments, a lower portion 23 (not visibly shown in FIG. 1, but shown in FIGS. 5, 7, and 8) of the post 22 passes through a first bore 24 defined by the enclosure 16 which extends into the opening 18 and is threadably received by a second bore 25 (not visibly shown in FIG. 1, but shown in FIG. 7; referenced as 25' in FIG. 8) defined further by the enclosure 16 and extending out of the opening 18. In certain embodiments, the support arm insert portion 20 has a pair of protrusions 26 extending therefrom which engage the segment of the post 22. This engagement between the protrusions 26 and the post 22 enables the enclosure 16 to pivot or rotate with respect to the support arm (referenced as 14' in FIGS. 1 and 14" in FIG. 2), as shown by a comparison between the enclosure 16 positions in FIGS. 1 and 2. In particular, the enclosure 16 can rotate about an axis 28 (not shown in FIG. 1, but shown in FIGS. 7 and 8) passing longitudinally through the center of the post 22. As shown, the rotation of the enclosure 16 about the axis 28 is only impeded by the overall length 30 of the opening 18. As such, when either of opposing outer sides 32 of the support arm insert portion 20 contacts one of the corresponding inner sides 34 of the opening 18, further rotation of the enclosure 16 in that respective direction is prevented. As shown in FIGS. 1 and 2, the adjustment of the enclosure 16 in either direction 35A or 35B is generally about 30 degrees. As such, a maximum adjustment of the enclosure 16 wherein the support arm insert portion 20 moves from one opening inner side 34 to the other opening inner side 34 is generally about 60 degrees.

Figure 3:
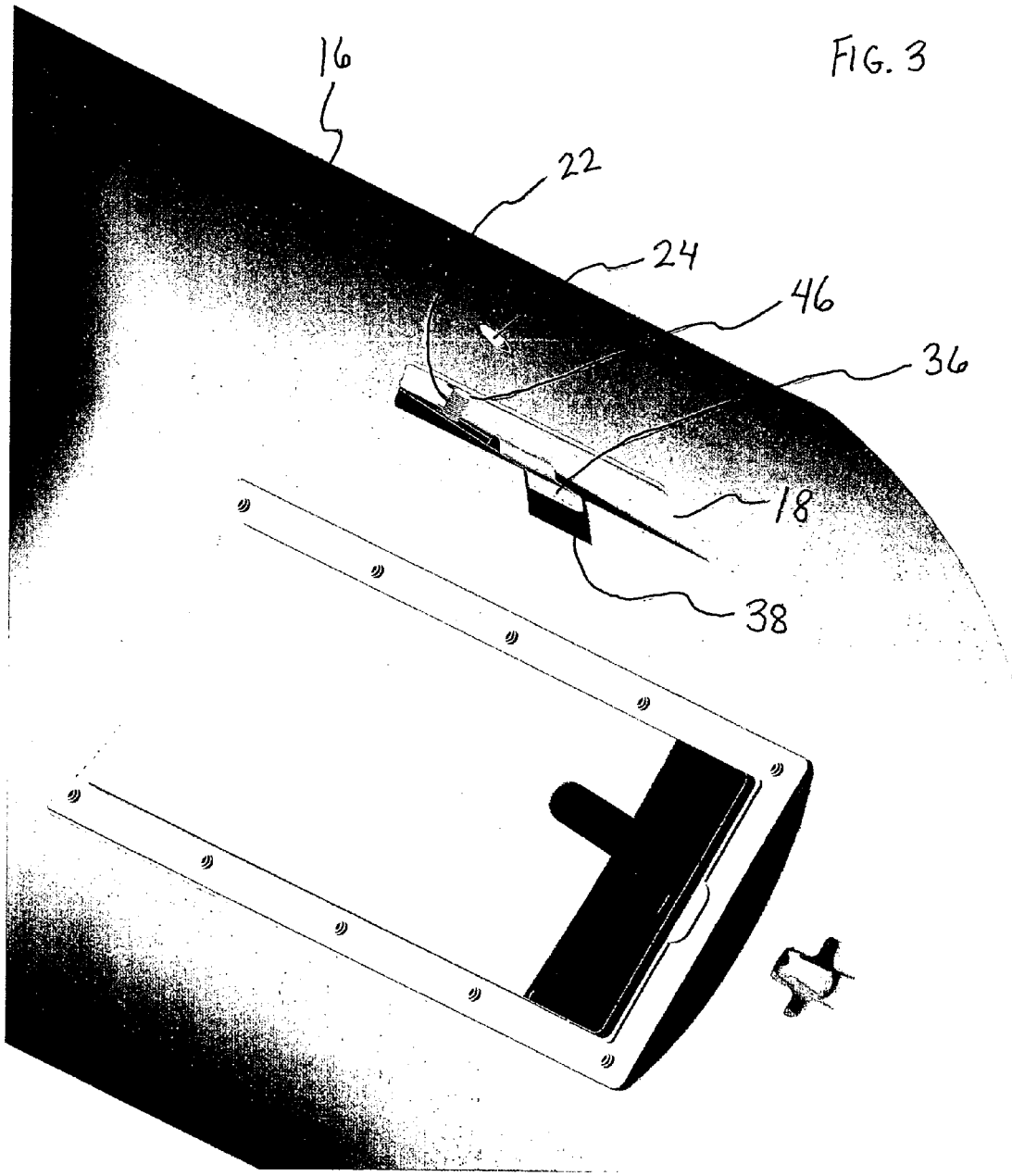
FIG. 3 shows a side perspective view of the enclosure of FIG. 2.

In certain embodiments, the enclosure 16 further includes a latch 36 partially illustrated in FIGS. 2 and 3. As shown, the latch 36 extends from the enclosure opening 18 and is partially oriented within a channel 38 of the opening 18. When inserting the support arm insert portion 20 in the enclosure opening 18, the latch 36 partially contacts the insert portion 20. In certain embodiments, the latch 36 is made of a flexible material (e.g., plastic or metal) so as to enable the latch 36 to temporarily deflect within the channel 38 when such contact is made between the latch 36 and the insert portion 20. This deflection of the latch 36 enables the support arm insert portion 20 to be further received by the opening 18 until the inner surfaces of protrusions 26 of the insert portion 20 engage the post 22.

Figure 4:
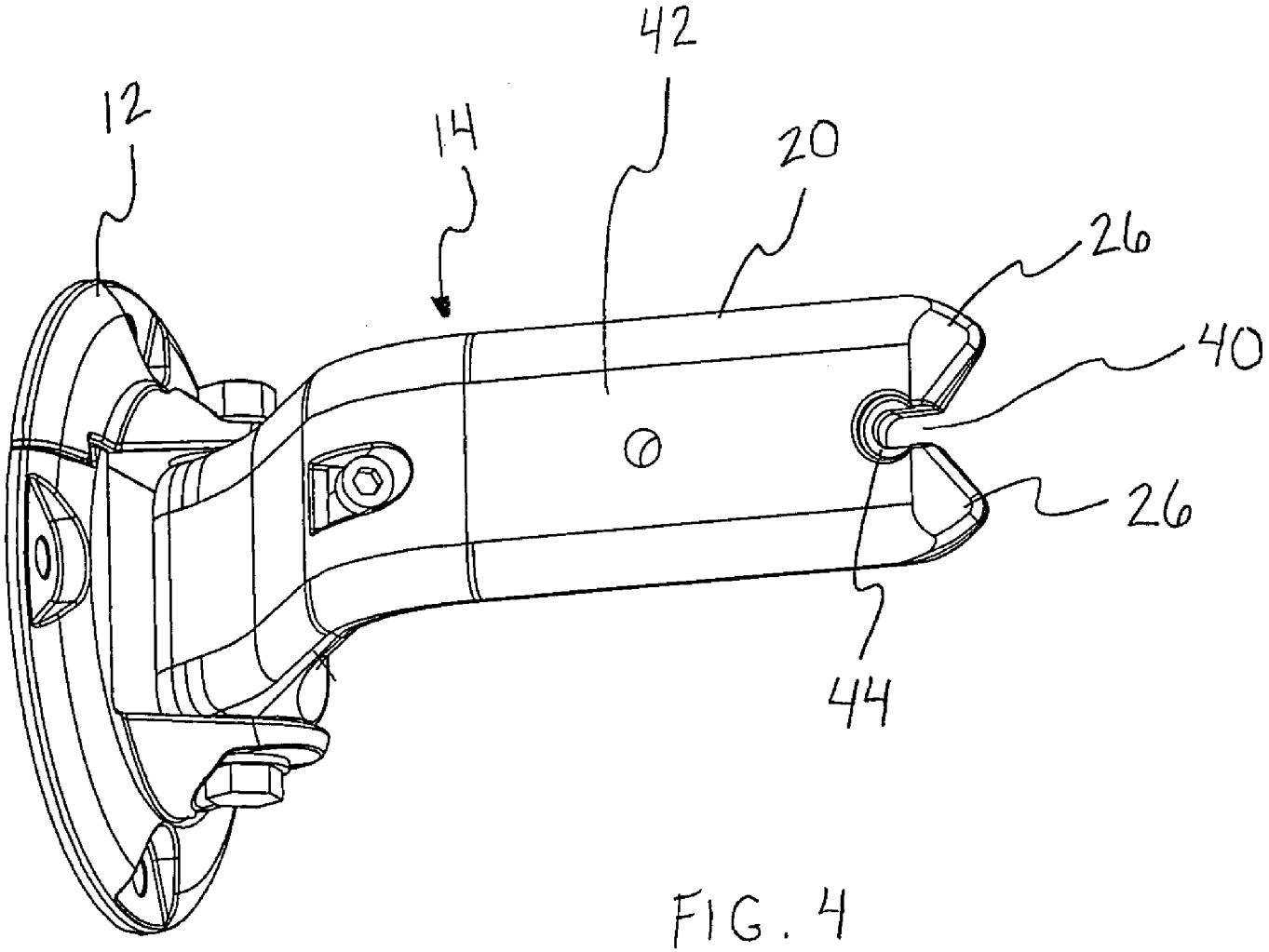
FIG. 4 shows a top perspective view of a support arm and mounting bracket of FIGS. 1 and 2.
Figure 7:
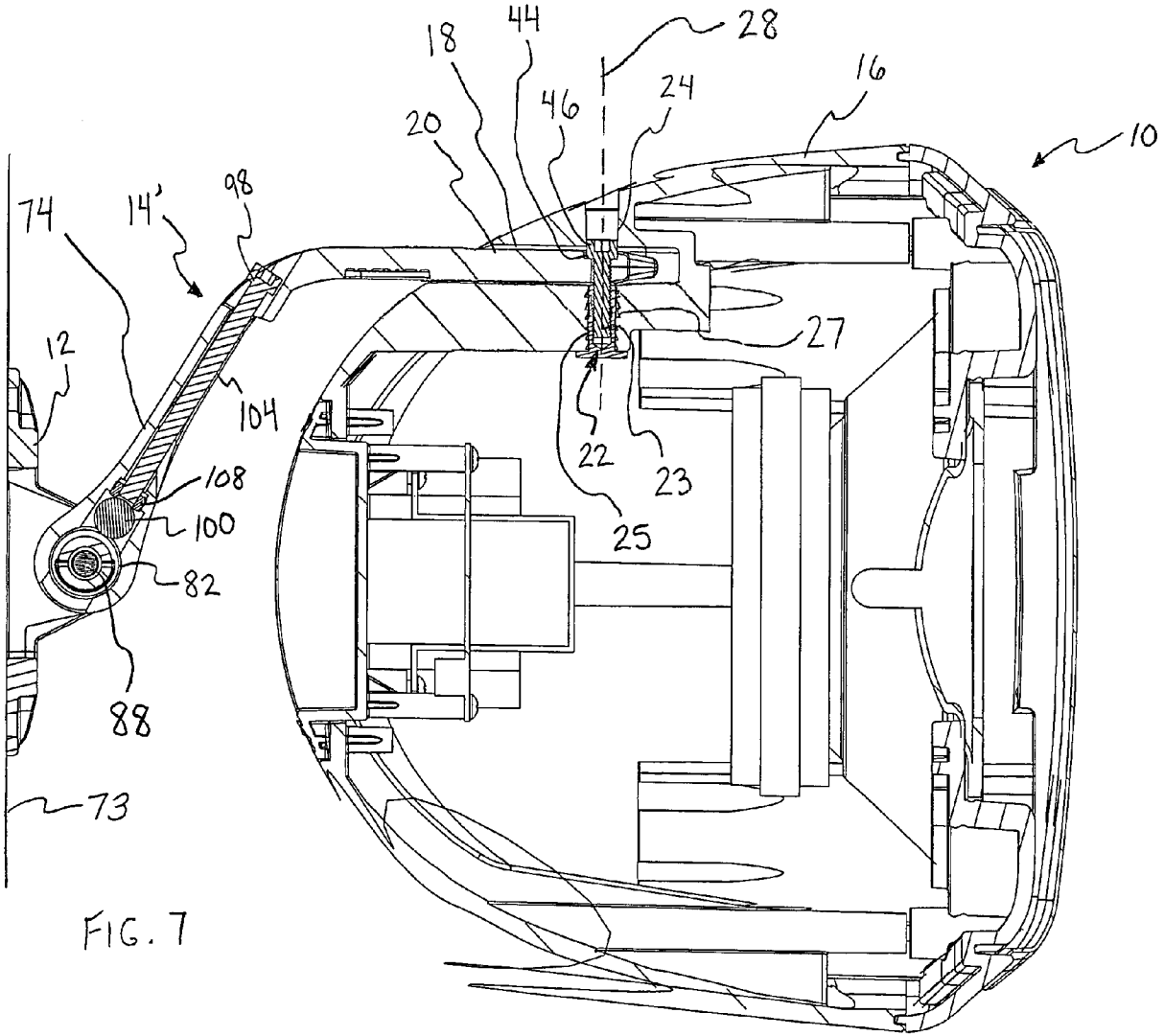
FIG. 7 shows a side cross sectional view of the enclosure and mounting assembly taken along the lines 7-7 of FIG. 1.
Figure 8:
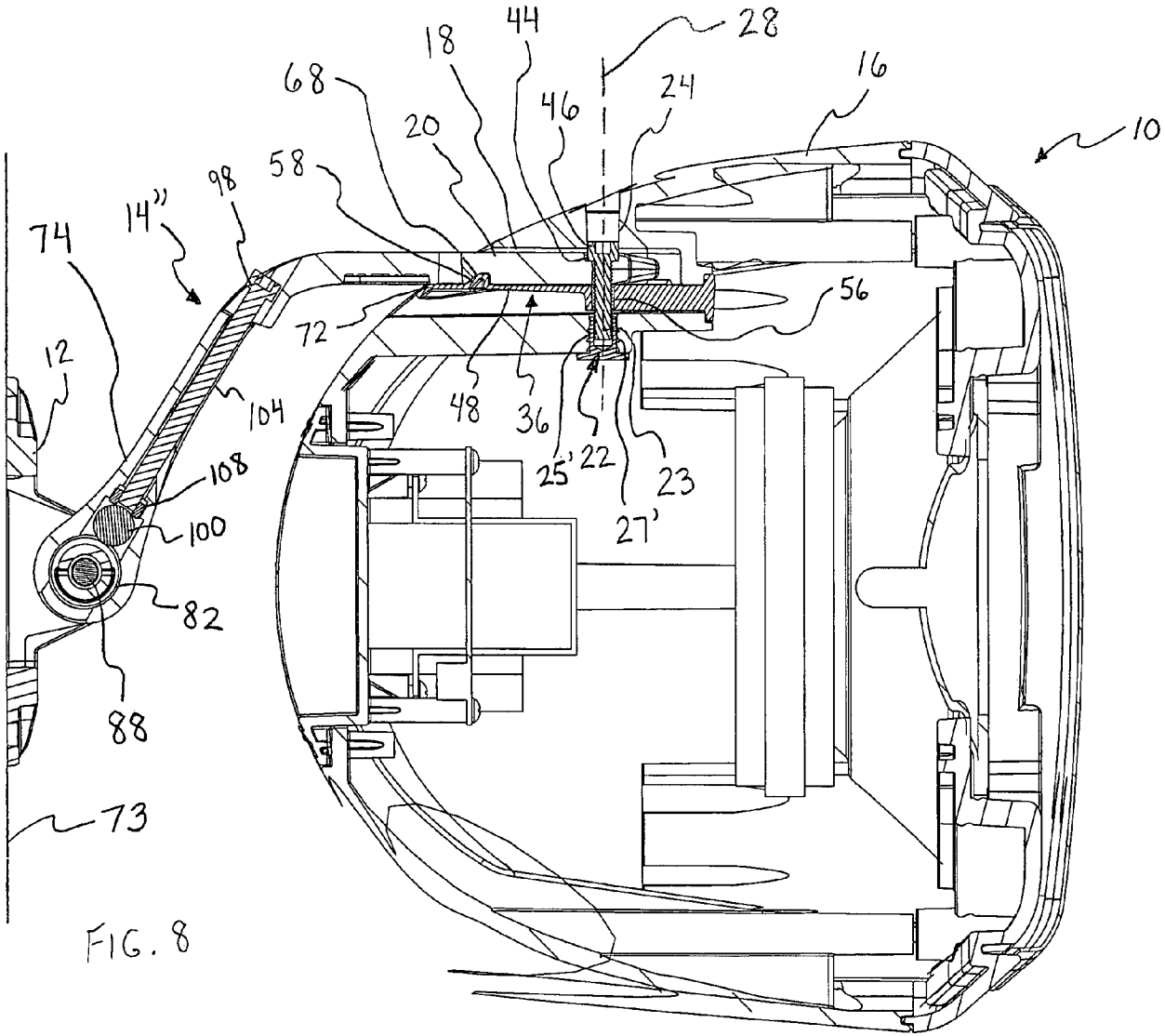
FIG. 8 shows a side cross sectional view of the enclosure and mounting assembly taken along the lines 8-8 of FIG. 2.

As described above, with reference to FIGS. 1 and 2 respectively, the support arms 14', 14" extend from the mounting bracket 12 and include the insert portion 20 that is received by the opening 18 of the enclosure 16. The protrusions 26 of the insert portion 20 define a gap 40 therebetween which is designed to receive the segment of the post 22 passing through the opening 18. In certain embodiments as shown in FIG. 4, on a first major surface 42 of the insert portion 20, a semi-circular indentation 44 is formed into the protrusions 26 and located proximate to an innermost region of the gap 40. FIG. 4 is a perspective view illustrating the support arm 14 (referenced as 14' in FIGS. 1 and 14" in FIG. 2) and bracket 12. The indentation 44 is used to function with a top portion 46 of the post 22, shown in FIG. 3. The indentation 44 is sized accordingly to partially receive the top portion 46 of the post 22. In certain embodiments, the post 22 is a hex capped screw and the top portion 46 of the post 22 is a hex socket head. Following engagement of the support arm insert portion 20 with the post 22 and rotation of the enclosure 16 with respect to the support arm 14 (if desired), the post 22 is tightened so that the post top portion 46 engages against the indentation 44 as shown in FIGS. 7 and 8. This engagement between the post top portion 46 and the indentation 44 functions in locking the enclosure 16 in place with respect to the support arm 14.

Figure 5:
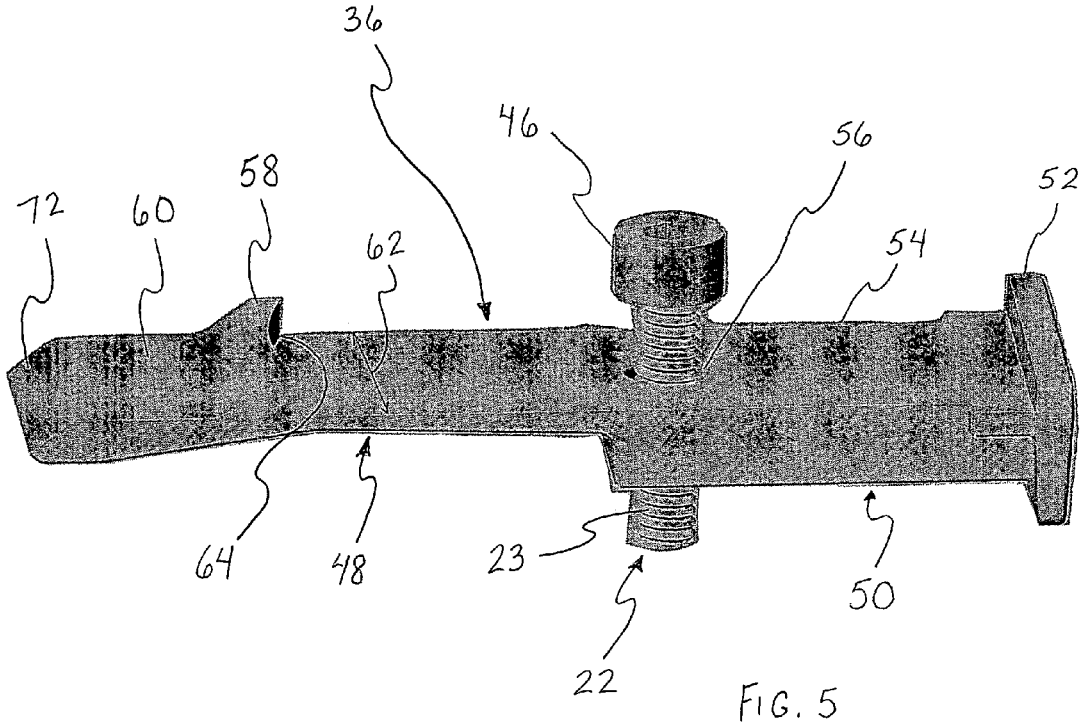
FIG. 5 shows a side perspective view of a latch and post of the enclosure of FIG. 2.

As described above, in certain embodiments, the enclosure 16 further includes the latch 36. FIG. 5 shows a perspective view of the latch 36 and the post 22. The latch 36 has a first portion 48 and a second portion 50. The second portion 50 has a base 52 and a body 54 extending therefrom, both of which are rigidly fixed in place within the enclosure 16, as illustrated in FIG. 8. The second portion 50 further defines an aperture 56 through which the post 22 passes. In certain embodiments, the post 22 is threaded along a threaded lower portion 23 and aperture 56 is not threaded so as freely pass into the enclosure 16. In other embodiments, the aperture 56 is threaded to threadably engage the lower threaded portion 23 of the post 22. The first portion 48 extends across the opening 18 of the enclosure 16, and as partially shown in FIGS. 2 and 3, lies partially within the channel 38 of the opening 18. The first portion 48 has a tongue 58 protruding from a first or upper surface 60 thereof. In certain embodiments, the tongue 58 extends across the full width 62 of the latch 36 with an inner surface 64 of the tongue 58 curving inward with respect to the second portion 50 to assist with pivoting of the enclosure 16.

Figure 6:
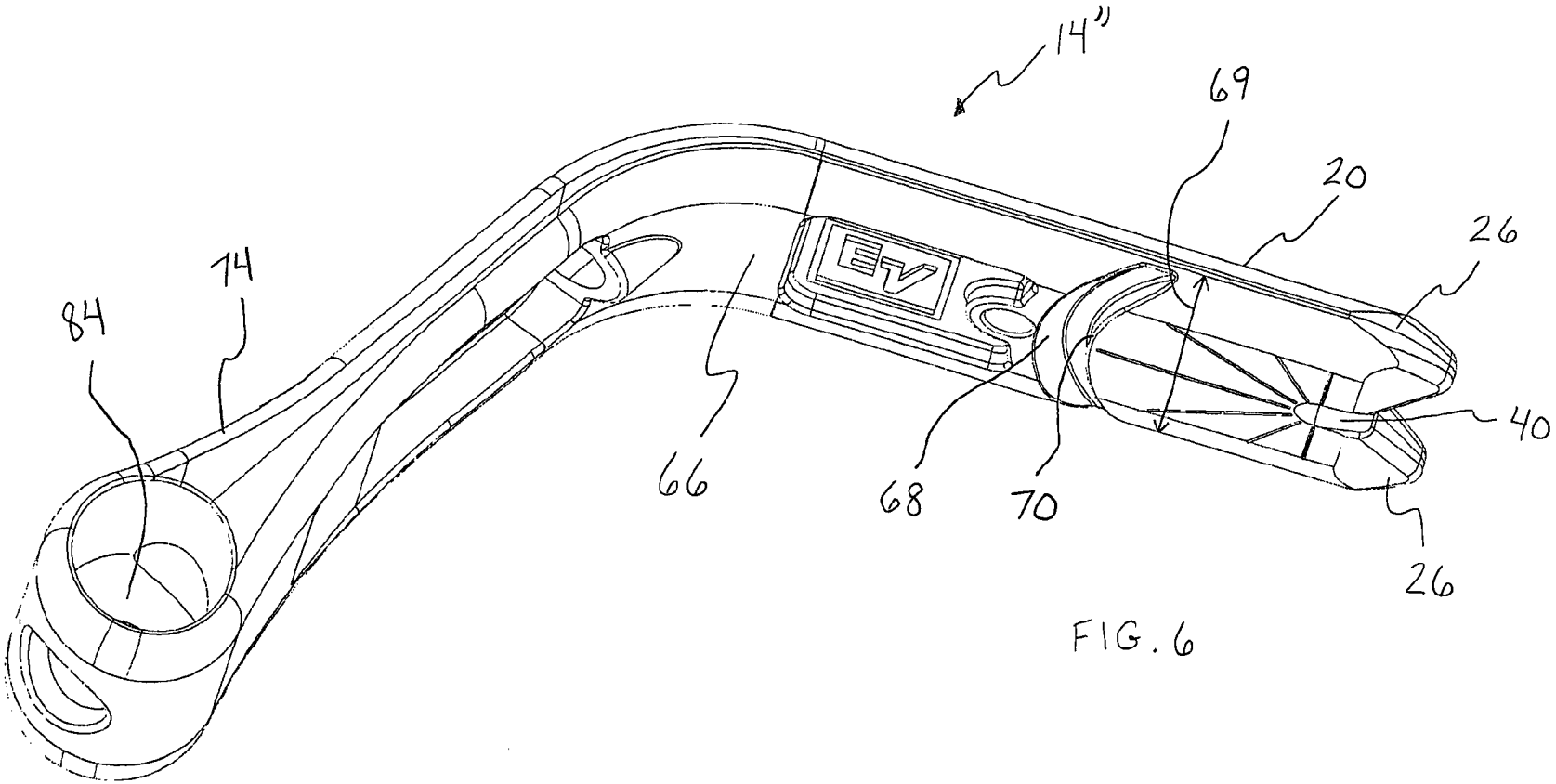
FIG. 6 shows a bottom perspective view of the support arm of FIG. 2.

FIG. 6 is a further perspective view of the support arm 14", illustrating a second major surface 66 thereof. In certain embodiments in which the latch 36 is used, the support arm 14" includes a groove 68 indented in the second major surface 66. As shown, in certain embodiments, the groove 68 extends across the full width 69 of the support arm 14" with an inner surface 70 of the groove 68 curving inward with respect to the insert portion 20 of the support arm 14" to follow the arcing motion of the latch and arm pivot. The groove 68 of the support arm 14" is sized accordingly to engage the tongue 58 of the latch 36 when the support arm insert portion 20 is inserted in the opening 18 and the protrusions 26 engage with the post 22, as shown in FIG. 7. The engagement between the tongue 58 and groove 68 functions so as to have the enclosure 16 automatically retain the support arm 14". The tongue 58 and groove 68 engage to form a tongue and groove type of coupling. As described herein, the tongue 58 and groove 68 have curvatures so as to further enable the rotation of the enclosure 16 about the support arm 14".

FIG. 7 illustrates a cross section of one embodiment of the speaker mounting system. As shown, the support arm 14' extends from the mounting bracket 12. In certain embodiments, the mounting bracket 12 is mounted to a surface 73 (e.g., a wall of a building). The insert portion 20 of the support arm 14' is received by the opening 18 of the speaker enclosure 16. As such, the protrusions 26 (only one of which is visibly shown) of the insert portion 20 engage the segment of the post 22 extending through the opening 18. The lower portion 23 of the post 22 is initially passed through the first bore 24 defined by the enclosure 16 so as to extend through the opening 18 and is threadably received by a threaded insert 27 inserted in the second bore 25 further defined by the enclosure 16. As described herein, the enclosure 16 is rotatable about the axis 28 extending through the longitudinal center of the post 22. Once the enclosure 16 is rotated to a desired position with respect to the support arm 14' (if necessary), the post 22 is tightened so the top portion 46 of the post 22 contacts and engages the indentation 44 in the support arm 14' as shown. The engagement of the post top portion 46 and the indentation 44 functions in locking the enclosure 16 in position with respect to the support arm 14'.

FIG. 8 illustrates a cross section of another embodiment of the speaker mounting system. Similar to what is shown with respect to FIG. 7, the support arm 14" extends from the mounting bracket 12. In certain embodiments, the mounting bracket 12 is mounted to a surface 73 (e.g., a wall of a building). The insert portion 20 of the support arm 14" is received by the opening 18 of the speaker enclosure 16. Likewise, the protrusions 26 (only one of which is visibly shown) of the insert portion 20 engage the segment of the post 22 extending through the opening 18. However, the enclosure 16 further includes the latch 36. As such, when the support arm insert portion 20 is inserted within the opening 18, the first portion 48 of the latch 36 contacts the insert portion 20. At least the first portion 48 of the latch 36 is made of a flexible material so as to deflect within the channel 38 (not visibly shown in FIG. 7, but shown in FIGS. 2 and 3) when the insert portion 20 contacts the latch first portion 48. It is to be appreciated that one could alternatively depress a front edge 72 (also shown in FIG. 5) of the latch first portion 48 while inserting the support arm insert portion 20 in the opening 18 to prevent such initial contact between the insert portion 20 and the latch first portion 48. Once the protrusions 26 of the insert portion 20 engage the post 22 extending through the opening 18, the tongue 58 of the latch 36 automatically inserts within the groove 68 of the support arm 14" to form a tongue and groove type of coupling between the enclosure 16 (via the latch 36) and the support arm 14" (via the groove 68). As such, this tongue and groove coupling functions in the support arm 14" retaining the enclosure 16. The lower portion 23 of the post 22 is initially passed through the first bore 24 defined by the enclosure 16 so as to extend through the opening 18, is passed through the aperture 56 defined by the latch 36, and is threadably received by a threaded insert 27' inserted in a second bore 25' further defined by the enclosure 16. As described herein, the enclosure 16 is rotatable about the axis 28 extending through the longitudinal center of the post 22. The tongue 58 and groove 68 are curved to accommodate such rotation. Once the enclosure 16 is rotated to a desired position with respect to the support arm 14", the post 22 is tightened so the top portion 46 of the post 22 contacts and engages the indentation 44 in the support arm 14" as shown. The engagement of the post top portion 46 and the indentation 44 functions in locking the enclosure 16 in position with respect to the support arm 14".

Figure 9:
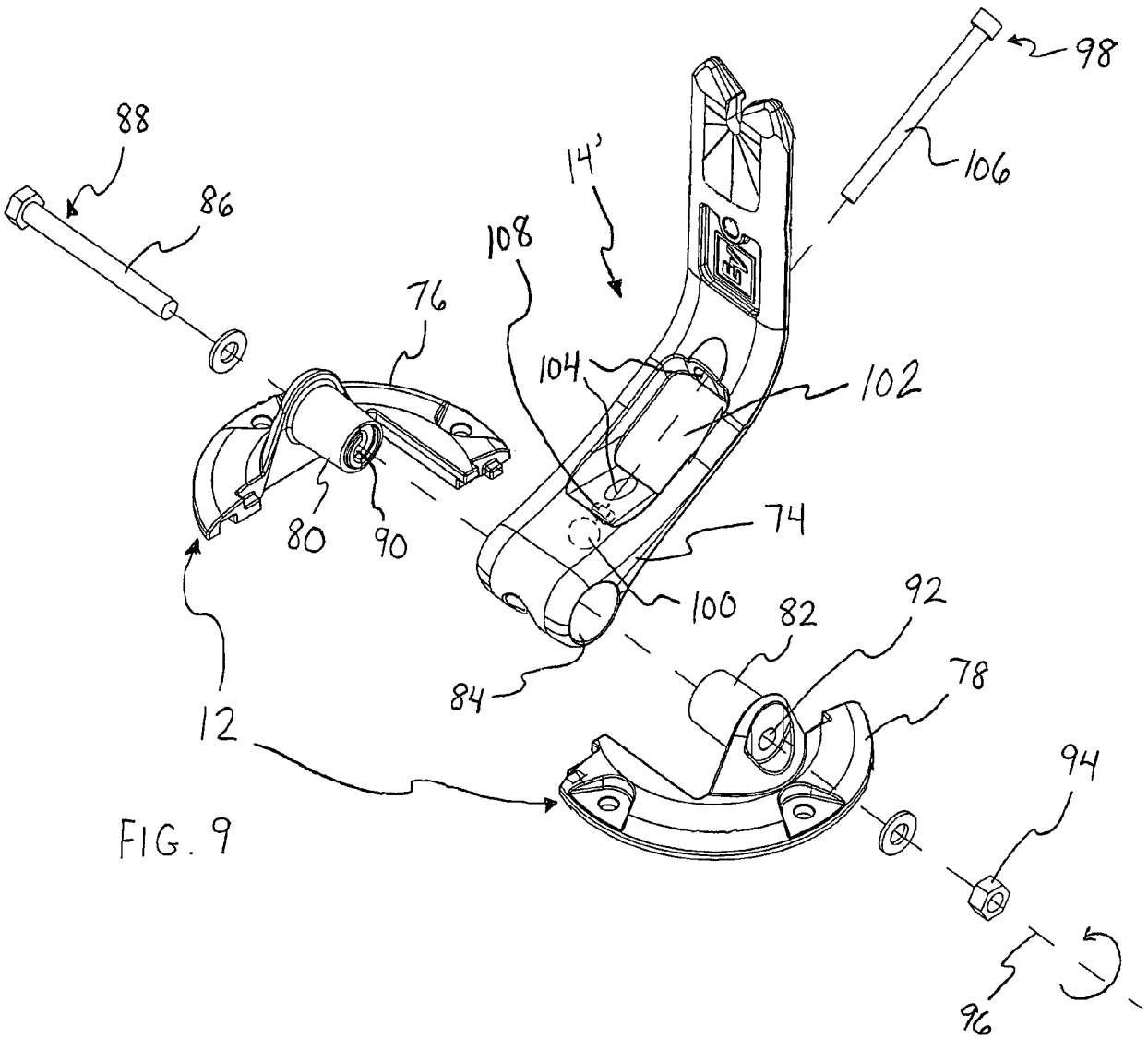
FIG. 9 shows an exploded bottom perspective view of a support arm and mounting bracket of FIG. 1.
Figure 10:
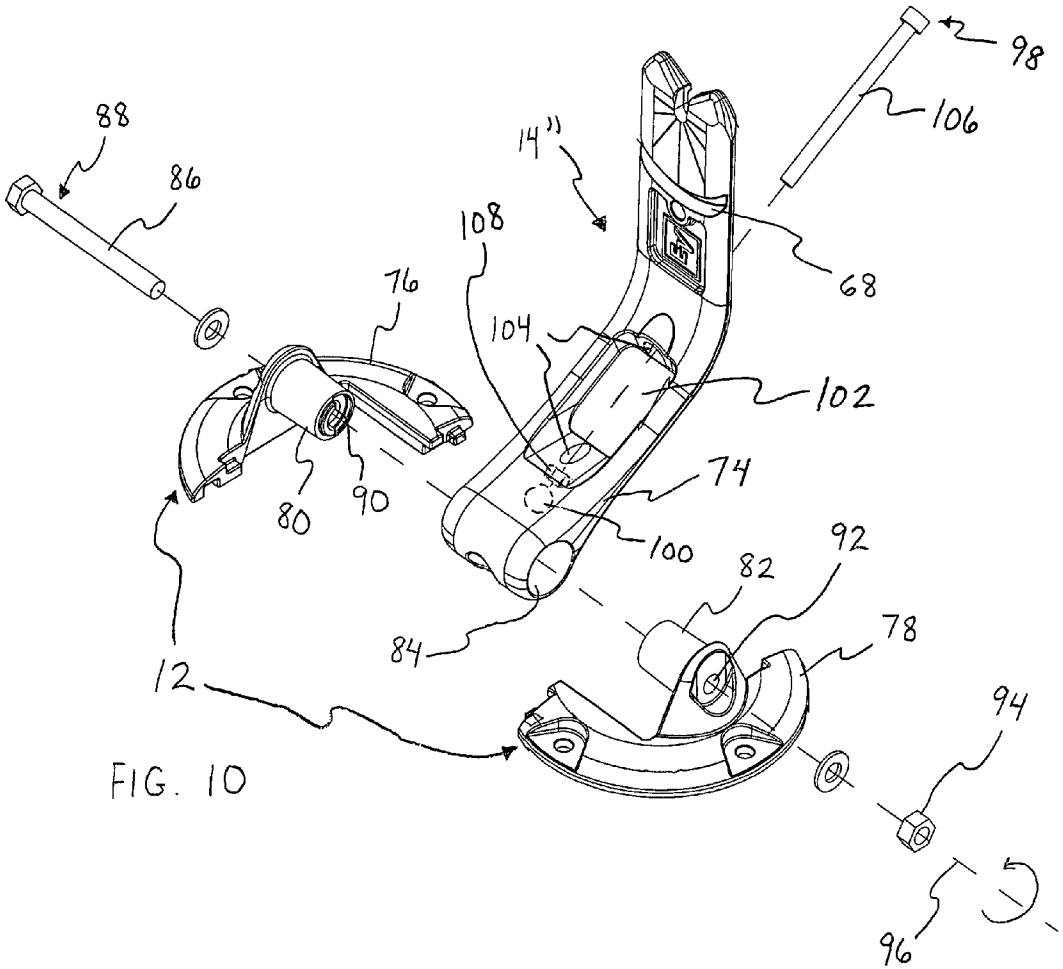
FIG. 10 shows an exploded bottom perspective view of a support arm and mounting bracket of FIG. 2.

Further, FIGS. 7 and 8 respectively illustrate the mechanism used in releasably coupling the support arms 14' and 14" and the mounting bracket 12. The support arms 14' and 14" include a looped portion 74, as shown in FIGS. 9 and 10. As also shown, the mounting bracket 12 is made of two adjoining halves 76 and 78 each with its own respective protruding member 80, 82. In uniting the halves 76, 78, the protruding members 80, 82 are joined within a cylindrical orifice 84 of the looped portion 74. In certain embodiments, a threaded portion 86 of a bolt 88 is subsequently passed through holes 90, 92 respectively defined by the protruding members 80, 82 and is threadably received by a nut 94 so as to tighten the united halves 76, 78 together.

As further shown in FIGS. 9 and 10, the respective support arms 14' and 14" are rotatable with respect to the mounting bracket 12 about an axis 96 extending through a centerline of the cylindrical orifice 84. Following adjustment of the support arms 14', 14" with respect to the mounting bracket 12, the position of the support arms 14', 14" are locked using a threaded bolt 98 and a ball bearing 100. In certain embodiments, the threaded bolt 98 is a hex capped screw. The support arm looped portion 74 includes a central portion 102 and a channel 104 extending through the central portion 102. The threaded bolt 98 extends through the channel 104 toward the mounting bracket 12. The ball bearing 100 is contained within the channel 104 between the bolt 98 and the protrusions 80, 82 of the mounting bracket 12. The threaded bolt 98 is threadably received within the channel 104 so as to be made adjustable with respect to the channel 104. In certain embodiments, a threaded portion 106 of the bolt 98 is received by a nut 108 retained in the channel 104 between the bolt 98 and the ball bearing 100. The nut 108 floats in a hexagonal pocket in the channel 104 that prevents rotation and axial movement of the nut. The bolt 98 can be adjusted to a first position as illustrated in FIGS. 7 and 8, in which the bolt 98 contacts the ball bearing 100 so that the ball bearing 100 further engages the protrusions 80, 82 (only protrusion 82 is visibly shown), thereby locking the respective support arms 14' and 14" in place with respect to the mounting bracket 12. Conversely, the threaded bolt 98 can be adjusted to a second position, in which the bolt 98 does not cause the ball bearing 100 to engage the protrusions 80, 82, thereby permitting pivoting of the support arms 14', 14" with respect to the mounting bracket 12 about the axis 96.

In certain embodiments, as respectively shown in FIGS. 7 and 8, the support arms 14' and 14" are pivotable about the mounting bracket 12 about the axis 96, and the enclosure 16 is pivotable about the support arms 14' and 14" about the axis 28. The axes 96 and 28 are non-parallel in order to provide two degrees of freedom of adjustment of the enclosure 16 about the mounting surface 73.

In other embodiments of the present invention, the cylindrical orifice 84 could be replaced with a ball socket and the protruding members 80, 82 could be replaced with hemispherical halves of a ball joint. In such an alternate embodiment, the support arms 14', 14" could pivot omni directionally about bracket 12 allowing for greater degrees of freedom. The screw 98 could still be used to in combination with the ball 100 and nut 108 to restrict movement of the support arm 14', 14" with respect to the bracket 12.

Thus, embodiments of the speaker mounting system are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A speaker mounting assembly for adjustably supporting a speaker from a mounting surface, the assembly comprising:

a support arm having an insert portion;

a speaker enclosure holding at least one transducer and defining a window opening, the window opening constructed to receive entry of the support arm insert portion;

a latch supported by the speaker enclosure extending from the window opening, the latch engaging with the insert portion to automatically retain the support arm when the insert portion is inserted into the window opening, the latch being releasable from the insert portion to permit removal of the support arm; and a mounting bracket attachable to a mounting surface for mounting the assembly to the mounting surface, the support arm extending from the mounting bracket.

2. The assembly of claim 1, wherein the latch and insert portion engagement permits the speaker enclosure to pivot about the support arm.

3. The assembly of claim 2, wherein a maximum amount of speaker enclosure pivot about the support arm is generally about 60 degrees.

4. The assembly of claim 2, further including a post extending within the enclosure window, the insert portion engaging the post when the latch is engaged to the insert portion so as to enable pivoting of the speaker enclosure with respect to the support arm.

5. The assembly of claim 2, wherein the support arm is pivotable about the mounting bracket about a first pivot axis, the speaker enclosure being pivotable about the support arm about a second pivot axis, the first and second pivot axes being non-parallel to provide two degrees of freedom of adjustment of the speaker enclosure about the mounting surface.

6. The assembly of claim 2, wherein the extent of the window opening limits the pivot of the speaker enclosure about the support arm.

7. The assembly of claim 1, wherein the latch and insert portion form a tongue and groove type of joint.

8. The assembly of claim 7, wherein the latch has the tongue of the tongue and groove joint and the insert portion has the groove of the tongue and groove joint.

9. The assembly of claim 8, wherein the insert portion contains an arcuate groove within which the tongue on the latch may traverse, whereby the traversal of the tongue within the groove permits the speaker enclosure to pivot about the support arm.

10. A speaker mounting assembly for adjustably supporting a speaker from a mounting surface, the assembly comprising:

a support arm having an insert portion and operatively attachable to a mounting surface for mounting the speaker to the mounting surface;

a speaker enclosure holding at least one transducer and defining a window opening, the window opening constructed to receive entry of the support arm insert portion; and a post extending within the enclosure window, the insert portion engaging the post so as to enable pivoting of the speaker enclosure about the support arm, wherein the post is adjustable, the adjustment of the post preventing the pivot of the speaker enclosure about the support arm.

11. The assembly of claim 10, further comprising a latch supported by the speaker enclosure within the window opening, whereby the latch engages with the insert portion to automatically retain the support arm when the insert portion is inserted into the window opening.

12. The assembly of claim 11, wherein the latch and insert portion form a tongue and groove type of joint.

13. The assembly of claim 10, wherein the post is threadably engaged to the enclosure, the adjustment being rotation of the post.

14. The assembly of claim 10, wherein the adjustment of the post involves a top portion of the post contacting an indentation of the support arm.

15. A lockable speaker mounting assembly for adjustably supporting a speaker from a mounting surface, the assembly comprising:

a support arm having an elongate central portion and a channel extending through the central portion;

a speaker enclosure holding at least one transducer and being releasably latchable to the support arm;

a mounting bracket attachable to a mounting surface for mounting the assembly to the mounting surface, the support arm extending from and pivoting about the mounting bracket, wherein the support arm has a cylindrical opening through which the mounting bracket extends, the cylindrical opening having a central axis about which the support arm pivots about the mounting bracket;

a set screw extending through the channel towards the mounting bracket, the set screw being adjustable from a first position that locks pivoting of the support arm about the mounting bracket to a second position that permits pivoting of the support arm about the mount bracket; and a bearing positioned between the set screw and the mounting bracket, the set screw bearing against the bearing and the mounting bracket when adjusted to the first position.

16. The assembly of claim 15, wherein the support arm is infinitely pivotable about the mounting bracket.

17. The assembly of claim 15, wherein the central channel includes a hexagonal pocket, the pocket holding and preventing rotation of a nut, and the set screw threadably engaging the nut.

18. The assembly of claim 15, wherein a head of the set screw is accessible via an orifice located at an elbow portion of the support arm, the orifice extending into the channel.

* * * * *